US011660864B2

(12) United States Patent
Katayama et al.

(10) Patent No.: US 11,660,864 B2
(45) Date of Patent: May 30, 2023

(54) LIQUID DISCHARGING HEAD

(71) Applicant: Brother Kogyo Kabushiki Kaisha, Nagoya (JP)

(72) Inventors: Hiroshi Katayama, Toyoake (JP); Shotaro Kanzaki, Handa (JP); Jiro Yamamoto, Nagoya (JP); Keita Sugiura, Toyokawa (JP); Taisuke Mizuno, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 56 days.

(21) Appl. No.: 17/345,014

(22) Filed: Jun. 11, 2021

(65) Prior Publication Data

US 2021/0402774 A1 Dec. 30, 2021

(30) Foreign Application Priority Data

Jun. 29, 2020 (JP) ..... JP2020-111246

(51) Int. Cl.
*B41J 2/14* (2006.01)
*B41J 2/155* (2006.01)
*B41J 2/18* (2006.01)

(52) U.S. Cl.
CPC ..... *B41J 2/14201* (2013.01); *B41J 2/155* (2013.01); *B41J 2/18* (2013.01); *B41J 2002/14459* (2013.01); *B41J 2202/08* (2013.01); *B41J 2202/12* (2013.01)

(58) Field of Classification Search
CPC . B41J 2/14201; B41J 2/155; B41J 2/18; B41J 2002/14459; B41J 2202/08; B41J 2202/12; B41J 2002/14306; B41J 2002/14419; B41J 2/14233; B41J 2202/11; B41J 2202/21
See application file for complete search history.

(56) References Cited

FOREIGN PATENT DOCUMENTS

JP 2011-520671 A 7/2011
WO 2009-143362 A1 11/2009

OTHER PUBLICATIONS

IP.com search (Year: 2022).*
JP-2016124191—Machine Translation "Liquid Discharge Head, Liquid Discharge Unit and Device For Discharging Liquid", Jul. 17, 2016, Description of Embodiments—Paragraphs 0021, 0028 (Year: 2016).*

* cited by examiner

*Primary Examiner* — Lisa Solomon
(74) *Attorney, Agent, or Firm* — Banner & Witcoff, Ltd.

(57) ABSTRACT

A liquid discharging head is provided with: individual channels; a first common channel; and a second common channel. The individual channels include: first individual channels which have first pressure chambers and which are aligned in a second direction to form a first individual channel array, and second individual channels which have second pressure chambers and which are aligned in the second direction to form a second individual channel array; the first individual channel array and the second individual channel array are arranged in a third direction. The first common channel communicates with both of the first individual channels and the second individual channels; and the first pressure chambers and the second pressure chambers do not overlap with the second common channel in a first direction, and do not overlap with each other in the second direction.

18 Claims, 9 Drawing Sheets

LIQUID DISCHARGING HEAD

CROSS REFERENCE TO RELATED APPLICATION

The present application claims priority from Japanese Patent Application No. 2020-111246, filed on Jun. 29, 2020, the disclosure of which is incorporated herein by reference in its entirety.

BACKGROUND

Field of the Invention

The present disclosure relates to a liquid discharging head provided with a plurality of individual channels, a first common channel and a second common channel.

Description of the Related Art

Published Japanese Translation of PCT International Publication for Patent Application No. 2011-520671 corresponding to International Publication No. WO2009/143362 discloses a liquid circulating system provided with a plurality of fluid passages (individual channels) each of which includes a fluid pumping chamber (pressure chamber) and a nozzle; and a liquid inlet passage (first common channel) and a recirculating channel (second common channel) which communicate with the plurality of fluid passages. A liquid inside the liquid inlet passage is supplied to the fluid pumping chamber of each of the plurality of fluid passages, flows from the fluid pumping chamber through a descending part; a part of the liquid flows to the nozzle, and the remaining part of the liquid flows to the recirculating channel.

In Published Japanese Translation of PCT International Publication for Patent Application No. 2011-520671 (see FIG. 1C), the plurality of fluid passages form a fluid passage array (row). One liquid inlet passage is provided as a common liquid inlet passage with respect to two pieces of the fluid passage array (namely, the two fluid passage arrays are fluidically connected to one liquid inlet passage). The recirculating channel is provided as recirculating channels arranged, respectively, on both sides of the fluid pumping chambers of the two fluid passage arrays.

The temperature of the liquid inside each of the individual channels is increased in a case that an actuator provided corresponding to the pressure chamber is driven. By accumulating, in the second common channel, the liquids having a high temperature in the respective individual channels, the temperature of the liquid in the second common channel might be further higher than that of the liquid in each of the individual channels.

In Published Japanese Translation of PCT International Publication for Patent Application No. 2011-520671, the fluid pumping chambers (pressure chambers) of each of the two fluid passage arrays do not overlap with the recirculating channel (second common channel) which stores a high-temperature liquid, in a direction orthogonal to the sheet surface of FIG. 1C (first direction). With this, any heat transmission from the second common channel to each of the pressure chambers is suppressed, which in turn makes it possible to suppress, to some extent, the increase in the temperature in the individual channel. In Japanese Patent Application Laid-open No. 2011-520671, however, the fluid pumping chambers (pressure chambers) of the two fluid passage arrays overlap with each other, in an overlap part therebetween, in an array direction (second direction) of the fluid passage arrays. In this case, the heat due to the liquids in the pressure chambers are concentrated in the overlap part, which in turn increase the temperature of the individual channel(s).

An object of the present disclosure is to provide a liquid discharging head capable of suppressing any increase in the temperature in the individual channel(s).

SUMMARY

According to the present disclosure, there is provided a liquid discharging head including:

a plurality of individual channels;

at least one first common channel communicating with the individual channels; and at least one second common channel communicating with the individual channels, wherein each of the individual channels includes:

a pressure chamber, a nozzle which is apart from the pressure chamber in a first direction, a connecting channel connecting the pressure chamber and the nozzle, a first communicating channel which has one end connected to the at least one first common channel and the other end connected to the pressure chamber, and at least one second communicating channel which has one end connected to the connecting channel and the other end connected to the at least one second common channel;

the individual channels include:

first individual channels which have first pressure chambers and which are aligned in a second direction orthogonal to the first direction to form a first individual channel array, and second individual channels which have second pressure chambers and which are aligned in the second direction to form a second individual channel array;

the first individual channel array and the second individual channel array are arranged in a third direction orthogonal to the first direction and the second direction;

the at least one first common channel includes one first common channel communicating with both of the first individual channels and the second individual channels; and the first pressure chambers and the second pressure chambers do not overlap with the at least one second common channel in the first direction, and do not overlap with each other in the second direction.

DESCRIPTION OF THE EMBODIMENTS

First Embodiment

Figure 1:
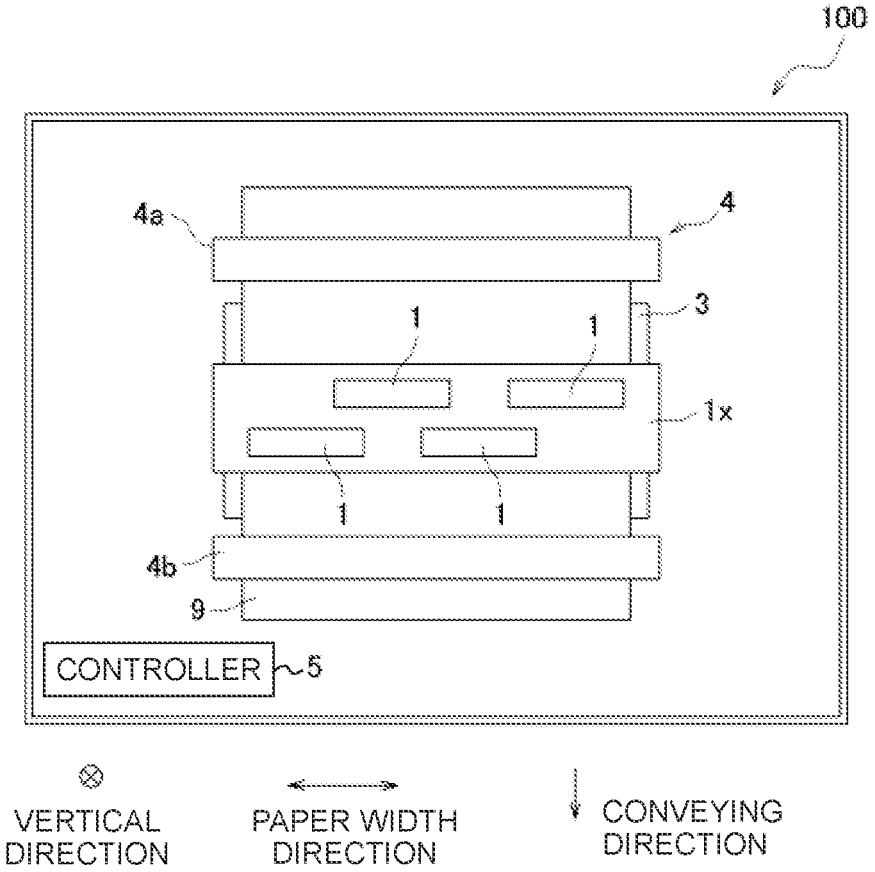
FIG. 1 is a plan view of a printer provided with a head according to a first embodiment of the present disclosure.

Firstly, an explanation will be given about the overall configuration of a printer 100 provided with a head 1 according to a first embodiment of the present disclosure, with reference to FIG. 1.

The printer 100 is provided with a head unit 1*x* including four pieces of the head 1, a platen 3, a conveying mechanism 4 and a controller 5.

Paper sheet (paper) 9 is placed on the upper surface of the platen 3.

The conveying mechanism 4 has two roller pairs 4*a* and 4*b* which are arranged, with the platen 3 being arranged or interposed therebetween in a conveying direction (a direction which is orthogonal to the vertical direction). In a case that a conveying motor (not depicted in the drawings) is driven by control of the controller 5, the two roller pairs 4*a* and 4*b* rotate in a state that the paper 9 is held (pinched) therebetween, thereby conveying the paper 9 in the conveying direction.

The head unit 1*x* is elongated in a paper width direction (a direction which is orthogonal to both of the conveying direction and the vertical direction) and is of a line system in which an ink is ejected or discharged from a nozzle 21 (see FIGS. 2 to 4) with respect to the paper 9 in a state that the position of the head unit 1*x* is fixed. Each of the four heads 1 is long in the paper width direction and the four heads 1 are arranged in a staggered manner in the paper width direction.

The controller 5 includes a ROM (Read Only Memory), a RAM (Random Access Memory) and an ASIC (Application Specific Integrated Circuit). The ASIC executes a recording processing, etc., in accordance with a program stored in the ROM. In the recording processing, the controller 5 controls a driver IC and a conveying motor (both of which are not depicted in the drawings) of each of the heads 1 based on a recording instruction (including image data) inputted from an external apparatus such as a PC, etc., and records an image on the paper 9.

Next, the configuration of each of the heads 1 will be explained, with reference to FIGS. 2 to 4.

Figure 4:
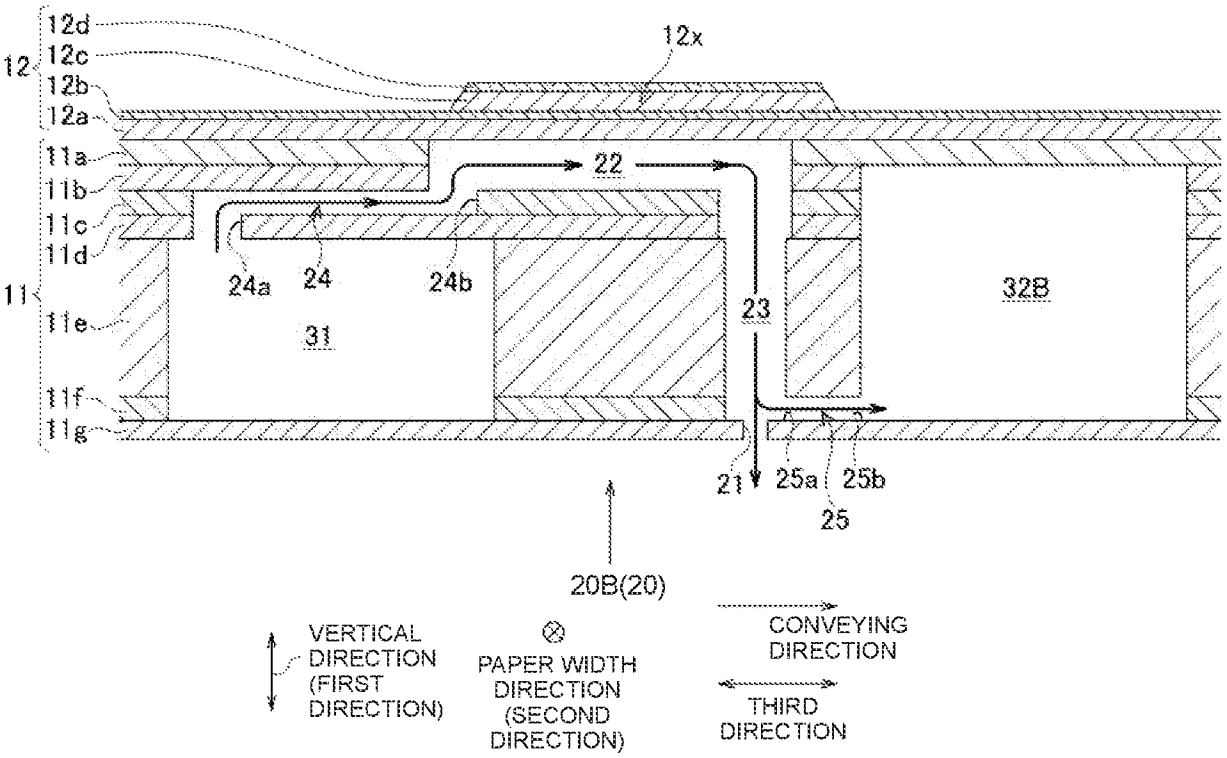
FIG. 4 is a cross-sectional view of the head along a line IV-IV in FIG. 2.

As depicted in FIG. 4, the head 1 has a channel member 11 and an actuator member 12.

The channel member 11 is constructed of seven plates 11*a* to 11*g* which are stack on one another in the vertical direction (first direction) and which are joined to one another. A through hole forming a channel is formed in each of the plates 11*a* to 11*g*.

The channel includes a plurality of individual channels 20, and one supply channel 31 and two return channels 32A and 32B each of which communicates with the plurality of individual channels 20. The supply channel 31 corresponds to a "first common channel" of the present disclosure, and the return channels 32A and 32B correspond to a "second common channel" of the present disclosure. More specifically, the common channel 31 corresponds to "one first common channel included in at least one first common channel", the return channel 32A corresponds to "one second common channel included in at least one second common channel", and the return channel 32B corresponds to "another second common channel included in the at least one second common channel".

Figure 2:
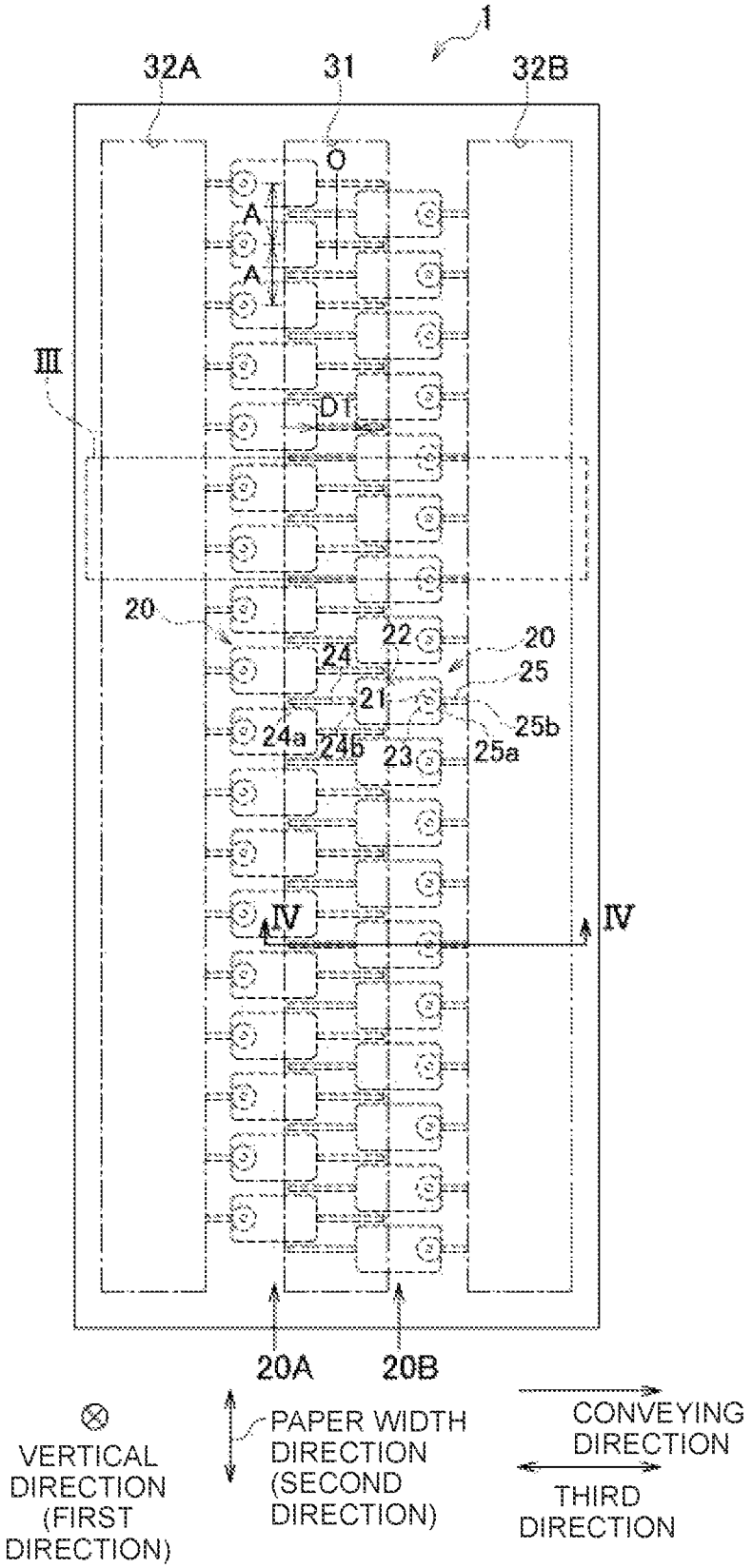
FIG. 2 is a plan view of the head according to the first embodiment of the present disclosure.

As depicted in FIG. 2, the supply channel 31 and the return channels 32A and 32B each extend in the paper width direction (second direction), and are arranged side by side in a direction parallel to the conveying direction (third direction). In the conveying direction, the supply channel 31 is arranged between the return channels 32A and 32B.

The plurality of individual channels 20 are arranged in a staggered manner in the paper width direction so as to form a first individual channel array 20A and a second individual channel array 20B. The first individual channel array 20A and the second individual channel array 20B are arranged side by side in the conveying direction. Namely, the plurality of individual channels 20 include first individual channels which are aligned in the paper width direction to form the first individual channel array 20A, and second individual channels which are aligned in the paper width direction to form the second individual channel array20B. The individual channels (first individual channels) 20 constructing the first individual channel array 20A communicate with the supply channel 31 and the return channel 32A. The individual channels (second individual channels) 20 constructing the second individual channel array 20B communicate with the supply channel 31 and the return channel 32B. Namely, the supply channel 31 communicates with both of the individual channels 20 constructing the first individual channel array 20A and the individual channels 20 constructing the second individual channel array 20B.

As depicted in FIG. 4, each of the plurality of individual channels 20 includes: a pressure chamber 22, a nozzle 21 which is apart from the pressure chamber 22 in the vertical direction, a connecting channel 23 connecting the pressure chamber 22 and the nozzle 21, an inflow channel 24 communicating the pressure chamber 22 and the supply channel 31, and an outflow channel 25 communicating the connecting channel 23 and the return channel 32A or 32B corresponding thereto. The inflow channel 24 corresponds to a "first communicating channel" of the present disclosure, and the outflow channel 25 corresponds to a "second communicating channel" of the present disclosure.

The nozzle 21 is constructed of a through hole formed in the plate 11*g*, and is opened in a lower surface of the channel member 11.

The pressure chamber 22 is constructed of through holes formed in the plates 11*a* and 11*b*, respectively, and is opened in the upper surface of the channel member 11. With respect to the pressure chamber 22, the connecting channel 23 is connected to one end in the conveyance direction of the pressure chamber 22, and the inflow channel 24 is connected to the other end in the conveyance direction of the pressure chamber 22.

The connecting channel 23 is a channel having a cylindrical shape and extending downward from the pressure chamber 22, and is constructed of through holes each of which is formed in one of the plates 11*c* to 11*f*. The nozzle 21 is arranged at a location immediately below the connecting channel 23.

The inflow channel 24 is constructed of through holes formed in the plates 11*c* and 11*d*, respectively, and has one end 24*a* communicating with the supply channel 31 and the other end 24*b* communicating with the pressure chamber 22. The one end 24*a* connects to the upper surface of the supply channel 31. The other end 24*b* connects to the lower surface of the pressure chamber 22.

The outflow channel 25 is constructed of a through hole formed in the plate 11*f*, and has one end 25*a* communicating with the connecting channel 23 and the other end 25*b* communicating with the return channel 32A or 32B corresponding thereto. The one end 25*a* connects to a side surface of the connecting channel 23. The other end 25*b* connects to a side surface of the return channel 32 (32A or 32B).

The supply channel 31 is constructed of through holes formed in the plates 11*e* and 11*f*, respectively; and each of the return channels 32A and 32B is constructed of through holes each of which is formed in one of the plates 11*b* to 11*f*. Each of the return channels 32A and 32B has a length in the vertical direction longer than that of the supply channel 31, and overlaps with the pressure chamber 22 in the conveyance direction. The plate 11*b* has the through hole constructing the pressure chamber 22 and the through holes constructing the return channels 32A and 32B.

Figure 3:
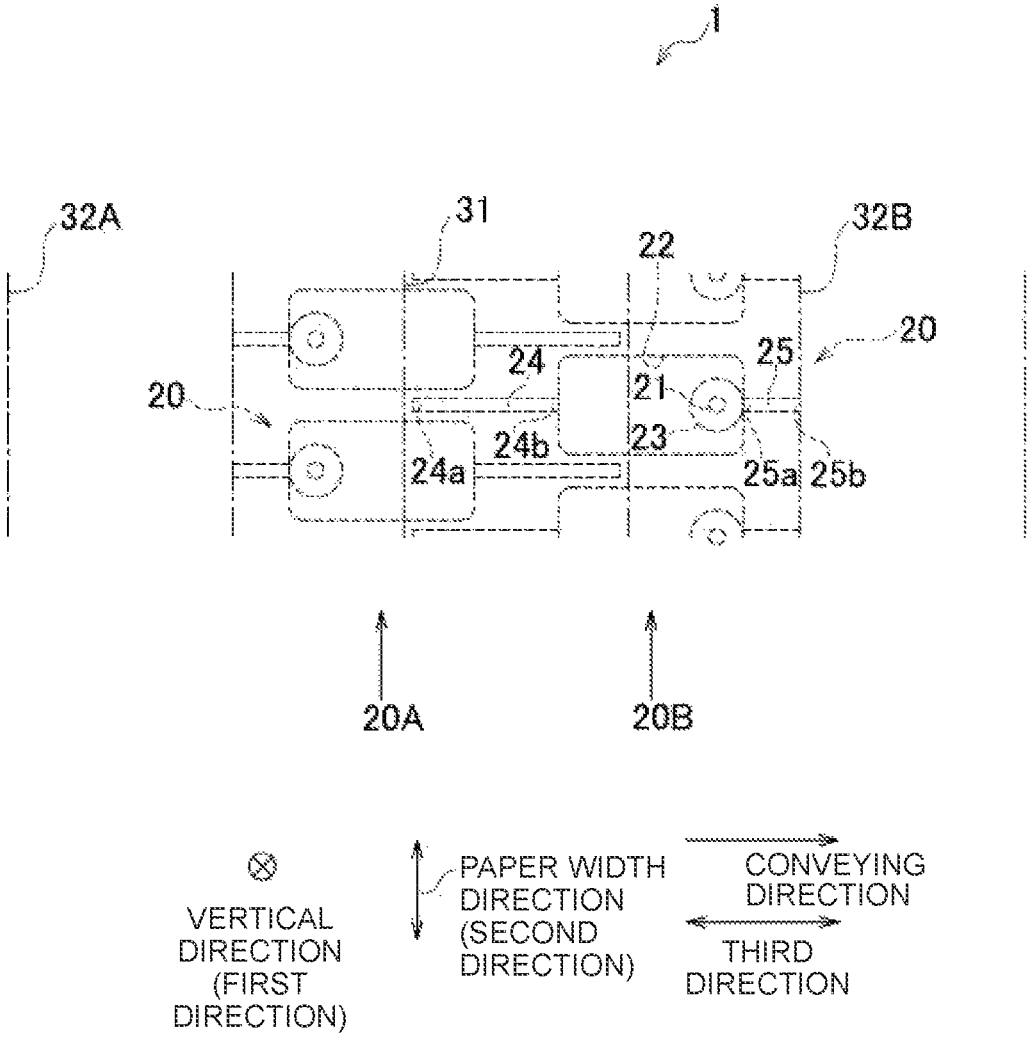
FIG. 3 is an enlarged view of an area III depicted in FIG. 2.

As depicted in FIG. 3, each of the inflow channel 24 and the outflow channel 25 has a width (length in the paper width direction) which is smaller than a width (length in the paper width direction) of the pressure chamber 22, and functions as a throttle. In each of the individual channels 20, the inflow channel 24 is arranged on one side in the conveying direction with respect to the nozzle 21, and the outflow channel 25 is arranged on the other side in the conveying direction with respect to the nozzle 21. The inflow channel 24 and the outflow channel 25 are parallel to each other, and each extend in the conveying direction.

The pressure chamber 22 has a rectangular shape which is long in the conveying direction in a plane orthogonal to the vertical direction. As depicted in FIG. 2, a plurality pieces of the pressure chamber 22 constructing each of the individual channel arrays 20A and 20B are aligned at an equal spacing distance of a pitch A in the paper width direction (width direction of the pressure chamber 22) therebetween. The pitch A is, for example, in a range of 50 μm to 100 μm. Here, the term "pitch" of the pressure chambers 22 indicates a center-to-center distance between the centers of two pressure chambers 22 which are adjacent in a plane orthogonal to the first direction, as seen from the first direction. The term "center of the pressure chamber 22" indicates, for example, the centroid of a view (plane view) in a case that the pressure chamber 22 is seen from the first direction.

Further, as depicted in FIG. 2, the pressure chambers (first pressure chambers) 22 of (belonging to) the first individual channel array 20A and the pressure chambers (second pressure chambers)22 of (belonging to) the second individual channel array 20B overlap with the supply channel 31 in the vertical direction, and do not overlap with the return channels 32A and 32B in the vertical direction.

The pressure chambers 22 of the first individual channel array 20A and the pressure chambers 22 of the second individual channel array 20B do not overlap with one another in the paper width direction, and are apart from one another in the conveying direction (in the conveying direction, a gap (spacing distance) D1 is provided or defined between the pressure chamber 22 of the first individual channel array 20A and the pressure chamber 22 of the second individual channel array 20B). The gap D1 is, for example, in a range of 100 μm to 200 μm.

The pressure chambers 22 of the first individual channel array 20A are arranged on one side in the conveying direction (left side in FIG. 2) with respect to a center O in the conveying direction of the supply channel 31; and the pressure chambers 22 of the second individual channel array 20B are arranged on the other side in the conveying direction (right side in FIG. 2) with respect to the center O. Further, the one end 24*a* of the inflow channel 24 of the first individual channel array 20A is positioned at an end part on the other side in the conveying direction (right end in FIG. 2) of the supply channel 31, and the one end 24*a* of the inflow channel 24 of the second individual channel array 20B is positioned at an end part on the one side in the conveying direction (left end in FIG. 2) of the supply channel 31.

Each of the supply channel 31 and the return channels 32A and 32B communicates with a sub tank (not depicted in the drawings). The sub tank communicates with a main tank which stores the ink, and stores the ink supplied from the main tank.

In a case that a pump (not depicted in the drawings) is driven by control of the controller 5, the ink inside the sub tank flows into the supply channel 31. The ink inflowed into the supply channel 31 is supplied to each of the individual channels 20 of the first and second individual channel arrays 20A and 20B, while moving inside the supply channel 31 in the paper width direction.

As depicted in FIG. 4, the ink supplied from the supply channel 31 to each of the individual channels 20 flows through the inflow channel 24 and inflows into the pressure chamber 22, and moves inside the pressure chamber 22 in a substantially horizontal manner, and flows into the connecting channel 23. This ink moves downward while passing through the connecting channel 23; a part of the ink is ejected or discharged from the nozzle 21, and a remaining part of the ink flows through the outflow channel 25 and flows out to the return channel 32A or 32B corresponding thereto.

The ink flows into the return channel 32A from each of the individual channels 20 of the first individual channel array 20A. The ink flows into the return channel 32B from each of the individual channels 20 of the second individual channel array 20B. The ink flows through the return channel 32 (return channels 32A and 32B), and is returned to the sub tank.

By circulating the ink between the sub tank and the channel member 11 in such a manner, it is possible to realize discharge (exhaust) of an air bubble and/or prevention of increase in the viscosity of the ink, in the supply channel 31, the return channels 32A and 32B, and further in each of the individual channels 20, which are formed in the channel member 11. Further, in a case that the ink contains a component which aggregates or precipitates (a component of which aggregation or precipitation might occur; a pigment, etc.), such a component is agitated and the aggregation (precipitation) of the component is prevented.

The actuator member 12 includes a vibration plate 12*a*, a common electrode 12*b*, a plurality of piezoelectric bodies 12*c*, and a plurality of individual electrodes 12*d*, in this order from a lower part thereof.

The vibration plate 12*a* and the common electrode 12*b* are arranged on the upper surface of the channel member 11 (upper surface of the plate 11*a*), and cover all the plurality of pressure chambers 22 opened in the upper surface of the plate 11*a*. On the other hand, each of the plurality of piezoelectric bodies 12*c* and each of the plurality of individual electrodes 12*d* are provided on one of the plurality of pressure chambers 22, and overlap with one of the plurality of pressure chambers 22 in the vertical direction.

The common electrode 12*b* and the plurality of individual electrodes 12*d* are electrically connected to the driver IC (not depicted in the drawings). The driver IC changes the potential of each of the plurality of individual electrodes 12*d*, while maintaining the potential of the common electrode 12*b* to the ground potential. Specifically, the driver IC generates a driving signal based on a control signal from the controller 5, and applies the driving signal to each of the plurality of individual electrodes 12*d*. With this, the potential of each of the plurality of individual electrodes 12*d* is changed between a predetermined driving potential and the ground potential. In this situation, a part of the vibration plate 12*a* and a part of each of the plurality of piezoelectric bodies 12*c* (the parts being actuator 12*x*) which are sandwiched between one of the plurality of individual electrodes 12*d* and one of the plurality of pressure chambers 22 are deformed so as to project toward one of the plurality of pressure chambers 22. With this, the volume of one of the plurality of pressure chambers 22 is changed to thereby apply pressure to the ink in one of the plurality of pressure chambers 22, and causing the ink to be ejected or discharged from the nozzle 21. The actuator member 12 has a plurality of pieces of the actuator 12*x* each of which corresponds to one of the plurality of pressure chambers 22.

As described above, according to the present embodiment, the pressure chambers (first pressure chambers) 22 in the first individual channel arrays 20A and the pressure chambers (second pressure chambers) 22 in the second individual channel arrays 20B do not overlap with the return channels 32A and 32B in the vertical direction (first direction) (see FIG. 2). This suppresses any transfer of the heat to each of the plurality of pressure chambers 22 from the return channels 32A and 32B of which temperature might become higher than that in the plurality of individual channels 20. Further, the pressure chambers 22 in the first individual channel array 20A and the pressure chambers 22 in the second individual channel array 20B do not overlap with one another in the paper width direction (second direction). With this, it is possible to avoid any concentration of the heat due to the ink inside the pressure chambers 22. Thus, according to the present embodiment, it is possible to suppress any increase in the temperature in the plurality of individual channels 20.

Note that in a case that the temperature in the plurality of individual channels 20 is increased, the viscosity of the ink in the plurality of individual channels 20 is changed, which in turn causes any variation in the viscosity of the ink among the plurality of individual channels 20, leading to such a possibility that the discharge or ejection of the ink might be unstable. According to the present embodiment, it is possible to suppress the above-described problem and to realize a stable discharge or ejection of the ink.

The pressure chambers 22 in the first individual channel array 20A and the pressure chambers 22 in the second individual channel array 20B are apart from each other in the conveying direction (third direction) via the gap D1 (see FIG. 2). In this case, it is possible to avoid any concentration of the heat due to the ink inside the pressure chambers 22, in a more ensured manner. Accordingly, it is possible to suppress any increase in the temperature in the individual channels 20, in a more ensured manner.

The supply channel 31 is located on the upstream side of the individual channels 20 of which temperature might become high due to the driving of the actuators 12*x*. Accordingly, the temperature of ink inside the supply channel 31 may be lower than the temperature of the ink inside each of the individual channels 20. In the present embodiment, the pressure chambers 22 in the first individual channel array 20A and the pressure chambers 22 in the second individual channel array 20B overlap with the supply channel 31 in the vertical direction (first direction). In this case, it is possible to make the size of the head 1 to be small in the conveying direction (third direction), while suppressing any increase in the temperature of the individual channels 20.

The pressure chambers 22 of the first individual channel array 20A are arranged on one side in the conveying direction (third direction) (left side in FIG. 2) with respect to the center O in the conveying direction (third direction) of the supply channel 31; and the pressure chambers 22 of the second individual channel array 20B are arranged on the other side in the conveying direction (third direction) (right side in FIG. 2) with respect to the center O. Further, the one end 24*a* of the inflow channel 24 of the first individual channel array 20A is positioned at the end part on the other side in the conveying direction (third direction) (right end in FIG. 2) of the supply channel 31, and the one end 24*a* of the inflow channel 24 of the second individual channel array 20B is positioned at the end part on the one side in the conveying direction (third direction) (left end in FIG. 2) of the supply channel 31. In this case, it is possible to make the length of the inflow channel 24 to be long. Consequently, it is possible to make the flow rate in the inflow channel 24 to be great, and to allow the air inside the supply channel 31 to flow smoothly to the individual channels 20 and to discharge or exhaust the air to the return channels 32A and 32B, during the circulation.

Each of the return channels 32A and 32B has the length in the vertical direction (first direction) longer than the length in the vertical direction (first direction) of the supply channel 31 (see FIG. 4). In this case, by making the length in the vertical direction (first direction) of each of the return channels 32A and 32B to be long, and to make the volume of each of the return channels 32A and 32B to be great, it is possible to lower the channel resistance in each of the return channels 32A and 32B. Consequently, it is possible to increase a circulation amount of the ink and to efficiently release the heat inside the individual channels 20 to the return channels 32A and 32B. This makes it to possible to further suppress any increase in the temperature in the individual channels 20.

The return channels 32A and 32B overlap with the pressure chambers 22 in the conveying direction (third direction) (see FIG. 4). In this case, it is possible to release the heat from the pressure chambers 22 to the return channels 32A and 32B, thereby making it possible to further suppress any increase in the temperature in the individual channels 20.

Second Embodiment

Figure 5:
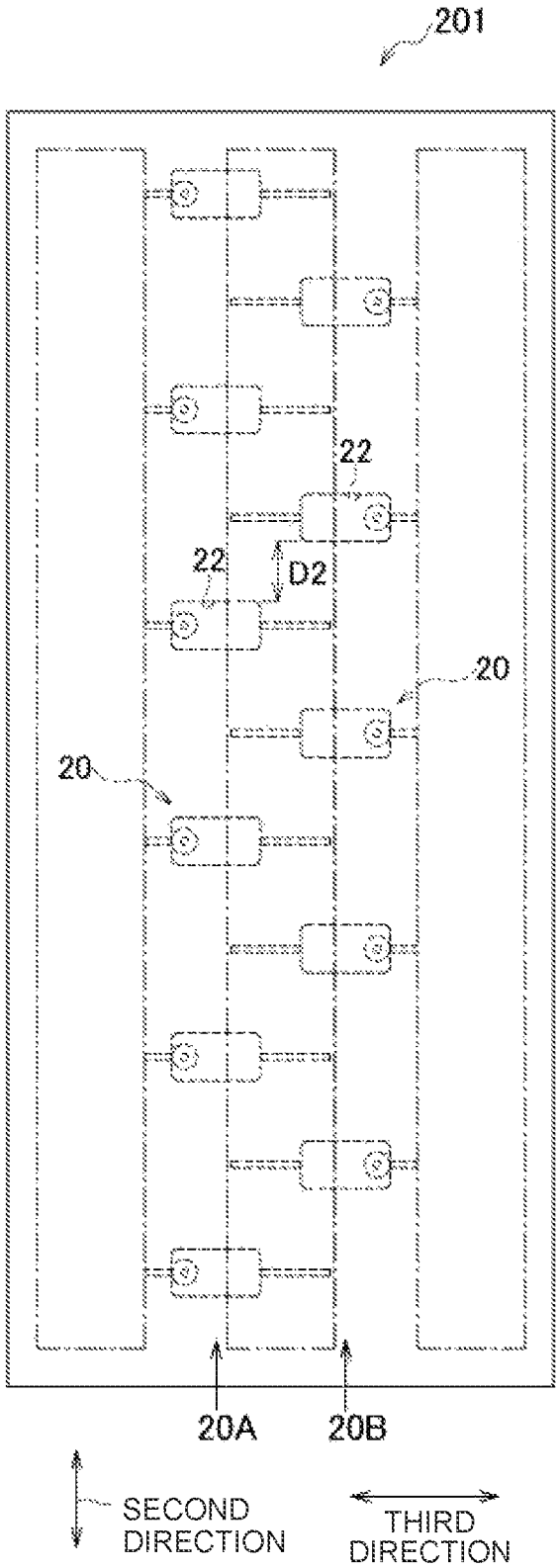
FIG. 5 is a plan view of a head according to a second embodiment of the present disclosure.

Next, an explanation will be given about a head 201 according to a second embodiment of the present disclosure, with reference to FIG. 5.

In the first embodiment (FIG. 2), the pressure chambers 22 in the first individual channel array 20A and the pressure chambers 22 in the second individual channel array 20B overlap with each other in the third direction. In contrast, in the second embodiment (FIG. 5), the pressure chambers 22 in the first individual channel array 20A and the pressure chambers 22 in the second individual channel array 20B do not overlap with each other in the third direction. In this case, it is possible to avoid any concentration of the heat due to the ink inside the pressure chambers 22, in a more ensured manner Thus, it is possible to suppress any increase in the temperature in the individual channels 20, in a more ensured manner.

Further, in the second embodiment, the pressure chambers 22 in the first individual channel array 20A and the pressure chambers 22 in the second individual channel array 20B are apart from each other in the second direction. Each of the second pressure chambers 22 are shifted in the second direction with respect to each of the first pressure chambers 22 (in the second direction, a gap (spacing distance) D2 is provided or defined between each of the pressure chambers 22 in the first individual channel array 20A and one of the pressure chambers 22 in the second individual channel array 20B which is adjacent thereto). The gap D2 is, for example, in a range of 50 μm to 100 μm. In this case, it is possible to avoid any concentration of the heat due to the ink inside the pressure chambers 22 in a more ensured manner. Thus, it is possible to suppress any increase in the temperature in the individual channels 20, in a more ensured manner.

Third Embodiment

Figure 6:
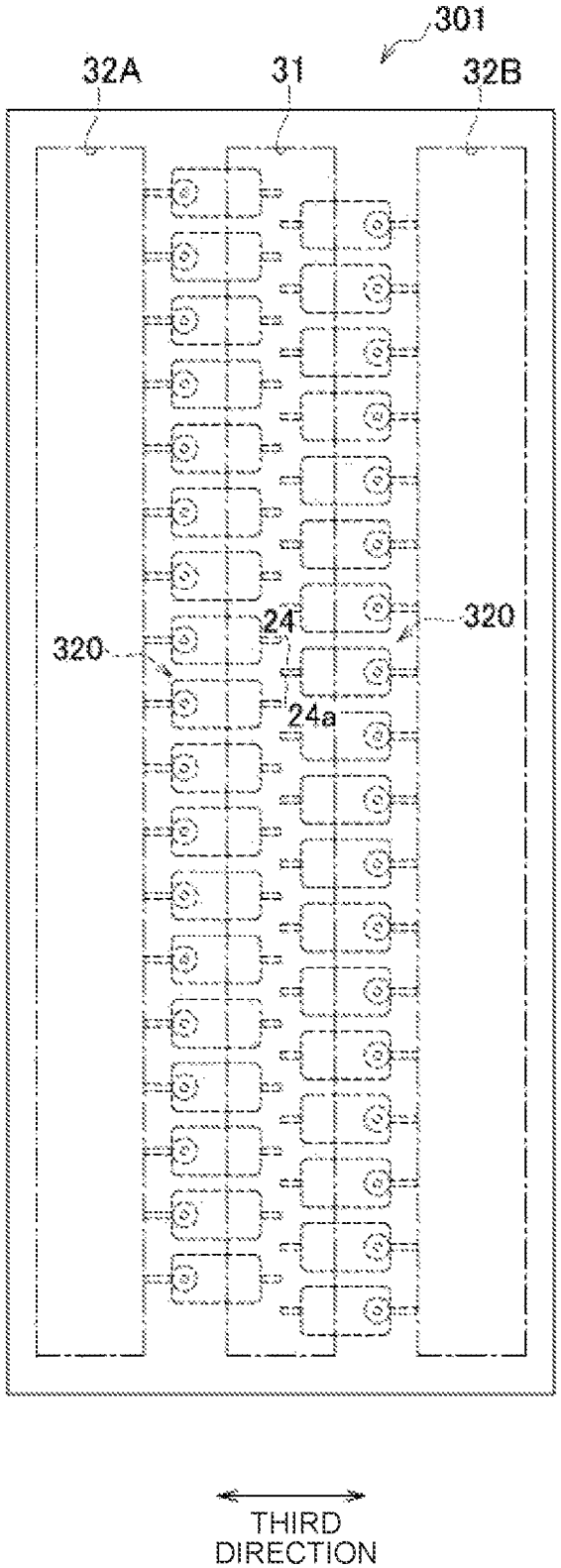
FIG. 6 is a plan view of a head according to a third embodiment of the present disclosure.

Next, an explanation will be given about a head 301 according to a third embodiment of the present disclosure, with reference to FIG. 6.

In the first embodiment (FIG. 2), in each of the individual channels 20 in the first individual channel array 20A, the one end 24*a* of the inflow channel 24 is positioned at the end part on the other side in the third direction (right end in FIG. 2) of the supply channel 31; and in each of the individual channels 20 in the second individual channel array 20B, the one end 24*a* of the inflow channel 24 is positioned at the end part on the one side in the third direction (left end in FIG. 2) of the supply channel 31. In contrast, in the third embodiment (FIG. 6), in each of individual channels 320 in the first and second individual channel arrays 20A and 20B, the one end 24*a* of the inflow channel 24 is located at a central part in the third direction of the supply channel 31.

The flow rate in the central part in the third direction of the supply channel 31 is great as compared with that in the end part(s) in the third direction of the supply channel 31. According to the third embodiment, by arranging the end part 24*a* of the inflow channel 24 at this central part, it is possible to flow the air inside the supply channel 31 smoothly to the individual channels 320 and to discharge or exhaust the air to the return channels 32A and 32B, during the circulation.

Fourth Embodiment

Next, an explanation will be given about a head 401 according to a fourth embodiment of the present disclosure, with reference to FIG. 7.

In the first embodiment (FIG. 2), the plurality of individual channels 20 construct the two individual channel arrays 20A and 20B. In contrast, in the fourth embodiment (FIG. 7), the plurality of individual channels 20 construct three individual channel arrays 20A to 20C. Namely, in the fourth embodiment, the plurality of individual channels 20 include third individual channels constructing the third individual channel array 20C, in addition to the first and second individual channel arrays 20A and 20B. The third individual channel array 30C interposes, in the third direction, the second individual channel array 20B between the first individual channel array 20A and the third individual channel array 20C.

Figure 7:
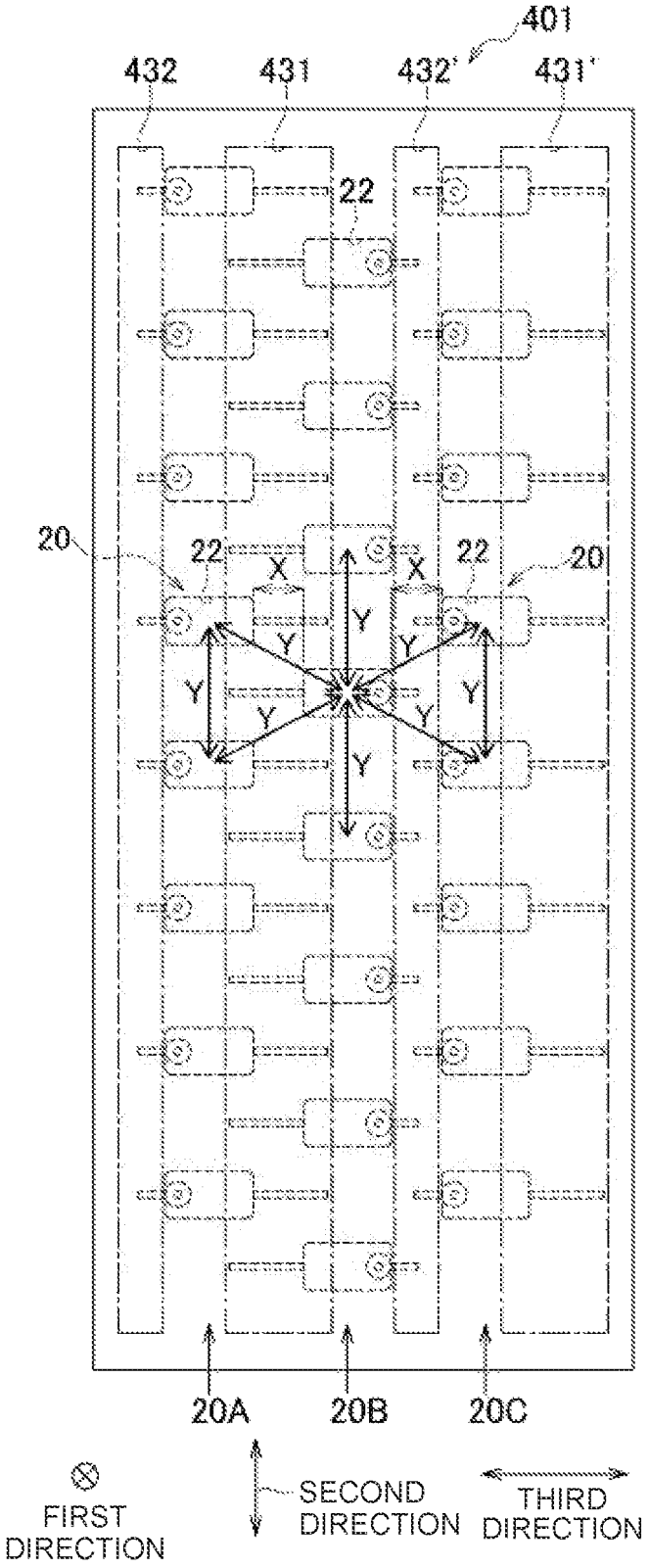
FIG. 7 is a plan view of a head according to a fourth embodiment of the present disclosure.

Here, a spacing distance X in the third direction between the pressure chambers (first pressure chambers) 22 of (belonging to) the first individual channel array 20A and the pressure chambers (second pressure chambers) 22 of the second individual channel array 20B, and a spacing distance X in the third direction between the pressure chambers (second pressure chambers) 22 of the second individual channel array 20B and the pressure chambers (third pressure chambers) 22 of the third individual channel array 20C are same as each other (see FIG. 7). According to this configuration, even in a case of providing the three individual channel arrays 20A to 20C, by arranging the pressure chambers 22 in the third direction at the equal spacing distance X therebetween, it is possible to avoid any concentration of the heat due to the ink inside the pressure chambers 22, and to suppress any increase in the temperature in the individual channels 20. Here, the phrase "spacing distance between the pressure chambers 22 in a predetermined direction" indicates the gap between the pressure chambers 22 in the predetermined direction, namely, the minimum distance in the predetermined direction between one pressure chamber 22 and another pressure chamber 22.

Further, the pressure chambers 22 constructing the first individual channel array 20A, the pressure chambers 22 constructing the second individual channel array 20B and the pressure chambers 22 constructing the third individual channel array 20C are arranged at an equal spacing distance therebetween (arranged at a same pitch) in a plane orthogonal to the first direction (see FIG. 7). Specifically, the pressure chambers 22 constructing each of the first to third individual channel arrays 20A to 20C are aligned at an equal spacing distance of a pitch Y in the second direction therebetween; further, with respect to each (a certain second pressure chamber 22) of the second pressure chambers 22, two of the first pressure chambers 22 which are closest to the certain second pressure chamber 22 are arranged at the pitch Y with respect to the certain second pressure chamber 22; with respect to each (the certain second pressure chamber 22) of the second pressure chambers 22, two of the third pressure chambers 22 which are closest to the certain second pressure chamber 22 are arranged at the pitch Y with respect to the certain second pressure chamber 22. In other words, a pressure chamber 22 belonging to the first individual channel array 20A, a pressure chamber 22 belonging to the second individual channel array 20B and a pressure chamber 22 belonging to the third individual channel array 20C are arranged in this order at the pitch Y in a direction which is orthogonal to the first direction and which crosses the second and third directions. By arranging all the pressure chambers 22 at the equal spacing distance therebetween (by arranging all the pressure chambers 22 at the same pitch) in such a manner, it is possible to avoid any concentration of the heat, due to the ink inside the pressure chambers 22, in a more ensured manner, and to suppress any increase in the temperature in the individual channels 20, in a more ensured manner.

Furthermore, the first embodiment (FIG. 2) is provided with a total of three common channels which are: the supply channel 31 communicating with the plurality of individual channels 20 constructing the first and second individual channel arrays 20A and 20B, the return channel 32A communicating with the individual channels 20 constructing the first individual channel array 20A, and the return channel 32B communicating with the individual channels 20 constructing the second individual channel array 20B.

In contrast, the fourth embodiment (FIG. 7) is provided with a total of four common channels which are: a supply channel 431 communicating with the individual channels (first and second individual channels) 20 constructing the first and second individual channel arrays 20A and 20B, a supply channel 431' communicating with the individual channels (third individual channels) 20 constructing the third individual channel array 20C, a return channel 432 communicating with the individual channels (first individual channels) 20 constructing the first individual channel array 20A, and a return channel 432' communicating with the individual channels (second and third individual channels) 20 constructing the second and third individual channel arrays 20B and 20C. The supply channel 431 corresponds to the "one first common channel included in the at least one first common channel" of the present disclosure, the supply channel 431' corresponds to "another first common channel included in the at least one first common channel" of the present disclosure, and the return channels 432 and 432' correspond to the "second common channel" of the present disclosure. More specifically, the return channel 432 corresponds to "one second common channel included in the at least one second common channel", and the return channel 432' corresponds to "another second common channel included in the at least one second common channel". Further, in the third direction, the supply channel 431 is arranged between the return channels 432 and 432'. Furthermore, in the third direction, the return channel 432' is arranged between the supply channels 431 and 431'. A length in the third direction (width) of each of the return channels 432 and 432' is shorter than a length in the third direction (width) of each of the supply channels 431 and 431'.

In particular, by making the length in the third direction of the return channel 432' to be short, as compared with those of the supply channels 431 and 431', it is possible to realize a configuration of arranging all the pressure chambers 22 at the equal spacing distance therebetween, in a more ensured manner.

Fifth Embodiment

Figure 8:
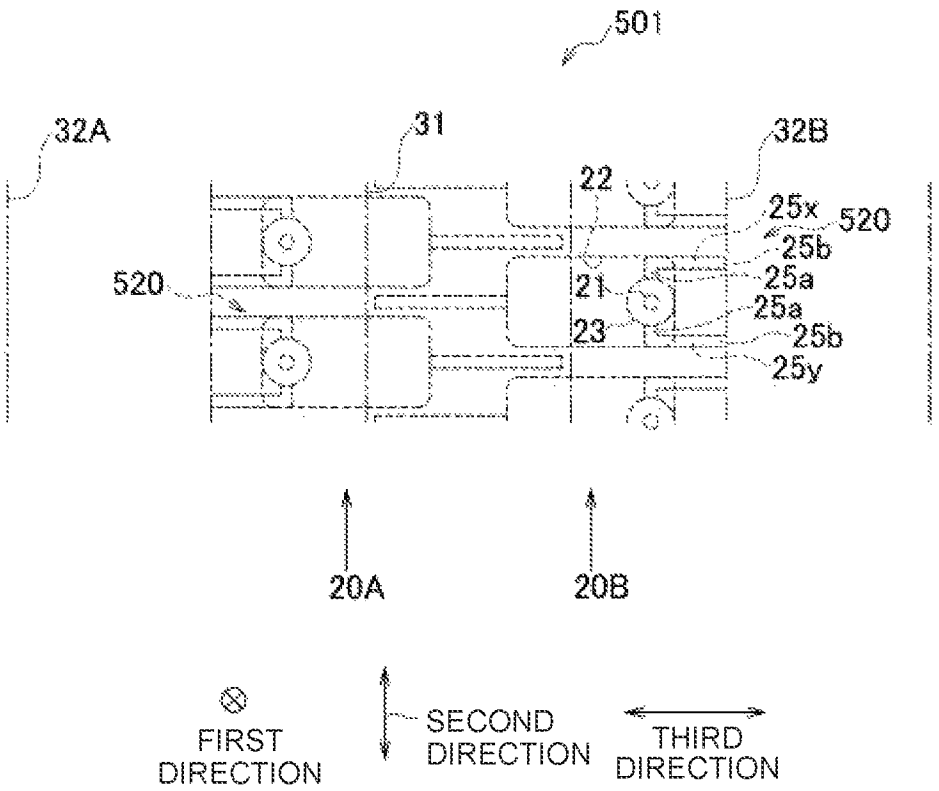
FIG. 8 is an enlarged view of a head according to a fifth embodiment of the present disclosure, corresponding to FIG. 3.

Next, an explanation will be given about a head 501 according to a fifth embodiment of the present disclosure, with reference to FIG. 8.

In the first embodiment (FIG. 2), each of the individual channels 20 includes one outflow channel 25. In contrast, in the fifth embodiment (FIG. 8), each of individual channels 520 includes two outflow channels 25*x* and 25*y*.

Each of the outflow channels 25*x* and 25*y* has one end 25*a* communicating with the connecting channel 23, and the other end 25*b* communicating with the return channel 32A or 32B corresponding thereto. The one end 25*a* connects to a side surface of the connecting channel 23. The other end 25*b* connects to a side surface of the return channel 32A or 32B corresponding thereto. The one end 25*a* of the outflow channel 25*x* is located on one side in the second direction with respect to the nozzle 21; and the one end 25*a* of the outflow channel 25*y* is located on the other side in the second direction with respect to the nozzle 21. The one ends 25*a* of the two outflow channels 25*x* and 25*y* are arranged symmetrically with respect to the nozzle 21. Further, the outflow channels 25*x* and 25*y* are arranged within the area of the pressure chamber 22 in the second direction. Namely, the entirety of each of the outflow channels 25*x* and 25 *y* overlaps with the pressure chamber 22 in the third direction, and has no part which does not overlap with the pressure chamber 22 in the third direction. The outflow channels 25*x* and 25*y* are located at positions, respectively, which are corresponding to the one end and the other end in the second direction of the pressure chamber 22, respectively.

Accordingly to the fifth embodiment, it is possible to efficiently release the heat inside each of the individual channels 20 via the two outflow channels 25*x* and 25*y* to the return channel 32A or 32B. With this, it is possible to further suppress any increase in the temperature in the individual channels 20.

Further, according to the fifth embodiment, since the two outflow channels 25*x* and 25*y* are provided with respect to each of the nozzles 21, the ink in the vicinity of the nozzle 21 is divided (dispersed) toward the two outflow channels 25*x* and 25*y* in a case that the circulation of the ink is performed during the recording. With this, any deviation or deflection of the flow of the ink can be mitigated, thereby making it possible to suppress occurrence of such a problem that a discharging or ejecting direction of the ink from the nozzle(s) 21 is deviated from a desired direction, as compared with a case in which only one outflow channel is provided.

Sixth Embodiment

Figure 9:
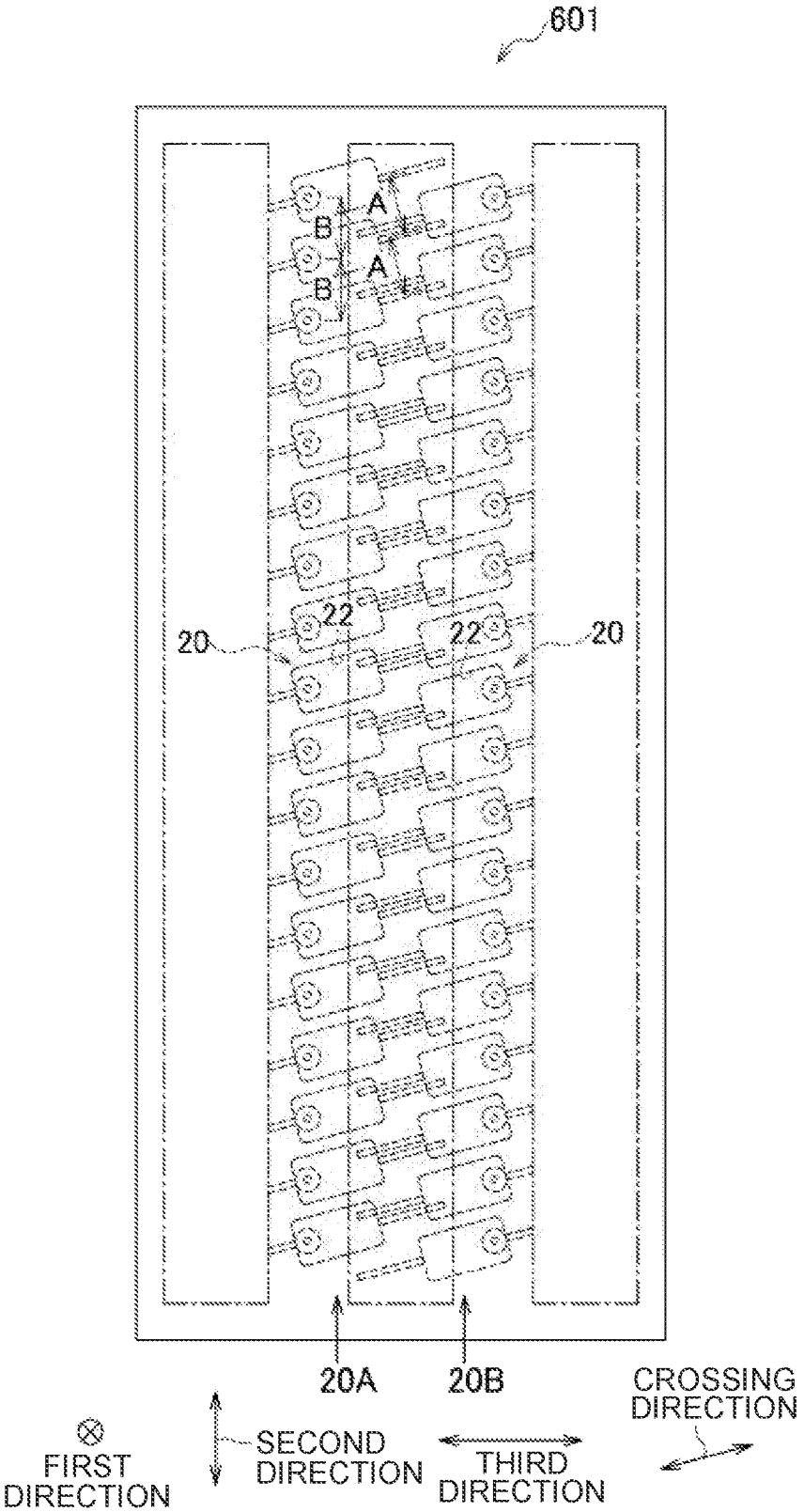
FIG. 9 is a plan view of a head according to a sixth embodiment of the present disclosure.

Next, an explanation will be given about a head 601 according to a sixth embodiment of the present disclosure, with reference to FIG. 9.

In the first embodiment (FIG. 2), each of the pressure chambers 22 extends in the third direction. In contrast, in the sixth embodiment (FIG. 9), each of the pressure chambers 22 extends in a direction orthogonal to the first direction and crossing the second and third directions (crossing direction). The plurality of pressure chambers 22 constructing each of the individual channel arrays 20A and 20B are aligned at an equal spacing distance of a pitch A, which is similar to that in the first embodiment, in a direction orthogonal to the direction in which the pressure chambers 22 extend (crossing direction).

According to the sixth embodiment, a pitch B (>A) in the second direction between adjacent pressure chambers 22 can be made great as compared with the configuration wherein the pressure chambers 22 extend in the third direction (first embodiment: FIG. 2). With this, it is possible to avoid any concentration of the heat due to the ink inside the pressure chambers 22 in a more ensured manner, and to suppress any increase in the temperature in the individual channels 20, in a more ensured manner.

Modification

Although the embodiments of the present disclosure have been described above, the present disclosure is not limited to or restricted by the above-described embodiments, and various design changes can be made within the scope of the claims.

In the first embodiment (FIG. 2), it is allowable that the pressure chambers 22 of the first individual channel array 20A and the pressure chambers 22 of the second individual channel array 20B do not overlap with the supply channel 31 in the first direction.

In the first embodiment (FIG. 2), it is allowable that the pressure chambers 22 of the first individual channel array 20A and the pressure chambers 22 of the second individual channel array 20B are not apart from one another in the third direction (the spacing distance D1 may be 0 (zero)).

In the second embodiment (FIG. 5), it is allowable that the pressure chambers 22 of the first individual channel array 20A and the pressure chambers 22 of the second individual channel array 20B are not apart from each other in the second direction (the spacing distance D2 may be 0 (zero)).

In the fifth embodiment (FIG. 8), it is allowable that each of the individual channels 20 includes three or more outflow channels. Further, it is allowable that the outflow channel has a part which is on the outside the area of the pressure chamber in the second direction.

In the above-described embodiments, although one pressure chamber is provided with respect to one nozzle, it is allowable that two or more pieces of the pressure chamber are provided with respect to one nozzle. Alternatively, in the above-described embodiments, although one nozzle is provided with respect to one pressure chamber, it is allowable that two or more pieces of the nozzle are provided with respect to one pressure chamber.

The head is not limited to being of the line system, and may be of a serial system in which the liquid is ejected or discharged from the nozzles to a discharge object while the head is moving in a scanning direction parallel to the paper width direction.

In the above-described embodiments, although the piezoelectric body 12*c* is provided on each of the pressure chambers 22, the present disclosure is not limited to this. It is allowable that the piezoelectric body 12*c* is provided so as to cover all the pressure chambers 22 which are opened in the upper surface of the plate 11*a*, similarly to the vibration plate 12*a* and the common electrode 12*b*. Further, although the actuator is of the piezoelectric system in the above-described embodiments, the present disclosure is not limited to this; it is allowable that the actuator is of another system (for example, thermal system using a heating element, an electrostatic system using the electrostatic force, etc.).

The discharge object is not limited to paper (paper sheet) and may be, for example, a recording medium such as cloth (fabric), a substrate, etc.

The liquid discharged or ejected from the nozzles is not limited to the ink, and may be an arbitrary liquid (e.g., a treating liquid, etc., which causes a component in the ink to aggregate or precipitate).

The present disclosure is not limited to the printer, and is also applicable to a facsimile machine, a copying machine, a multi-functional peripheral, etc. The present disclosure is also applicable to a liquid discharging apparatus used for an application different from the recording of an image (for example, a liquid discharging apparatus which discharges or ejects a conductive liquid onto a substrate to thereby form a conductive pattern on the substrate).

Note that the all the above-described embodiments and modifications may be combined with each other, unless mutually exclusive with one another.

What is claimed is:

1. A liquid discharging head comprising:

a plurality of individual channels;

a first common channel communicating with the individual channels; and at least one second common channel communicating with the individual channels, wherein each of the individual channels includes:

a pressure chamber, a nozzle which is apart from the pressure chamber in a first direction, a connecting channel connecting the pressure chamber and the nozzle, a first communicating channel which has one end connected to the first common channel and the other end connected to the pressure chamber, and at least one second communicating channel which has one end connected to the connecting channel and the other end connected to the at least one second common channel;

the individual channels include:

first individual channels which have first pressure chambers and which are aligned in a second direction orthogonal to the first direction to form a first individual channel array, and second individual channels which have second pressure chambers and which are aligned in the second direction to form a second individual channel array;

the first individual channel array and the second individual channel array are arranged in a third direction orthogonal to the first direction and the second direction;

the first common channel communicates with both of the first individual channels and the second individual channels; and the first pressure chambers and the second pressure chambers do not overlap with the at least one second common channel in the first direction, and do not overlap with each other in the second direction.

2. The liquid discharging head according to claim 1, wherein the at least one second common channel includes:

one second common channel communicating with the first individual channels; and another second common channel communicating with the second individual channels.

3. The liquid discharging head according to claim 1, wherein the first pressure chambers and the second pressure chambers are apart from each other in the third direction.

4. The liquid discharging head according to claim 1, wherein the first pressure chambers and the second pressure chambers do not overlap with each other in the third direction.

5. The liquid discharging head according to claim 4, wherein each of the second pressure chambers are shifted in the second direction with respect to each of the first pressure chambers.

6. The liquid discharging head according to claim 1, wherein the first pressure chambers and the second pressure chambers overlap with the first common channel in the first direction.

7. The liquid discharging head according to claim 1, wherein the first pressure chambers are arranged on one side in the third direction with respect to a center in the third direction of the first common channel;

the second pressure chambers are arranged on the other side in the third direction with respect to the center of the one first common channel;

the one end of the first communicating channel belonging to the first individual channel array is located at an end part of the one first common channel on the other side in the third direction; and the one end of the first communicating channel belonging to the second individual channel array is located at an end part of the first common channel on the one side in the third direction.

8. The liquid discharging head according to claim 1, wherein the one end of the first communicating channel is located at a central part in the third direction of the ene first common channel.

9. The liquid discharging head according to claim 1, wherein a length in the first direction of the at least one second common channel is longer than a length in the first direction of the first common channel.

10. The liquid discharging head according to claim 9, wherein the at least one second common channel overlaps with the pressure chambers in the third direction.

11. The liquid discharging head according to claim 1, wherein the individual channels further include third individual channels which have third pressure chambers and which are aligned in the second direction to form a third individual channel array;

the second individual channel array is arranged between the first individual channel array and the third individual channel array in the third direction; and a spacing distance in the third direction between the first pressure chambers and the second pressure chambers and a spacing distance in the third direction between the second pressure chambers and the third pressure chambers are same as each other.

12. The liquid discharging head according to claim 11, wherein the first pressure chambers, the second pressure chambers and the third pressure chambers are arranged at a same pitch therebetween in a plane orthogonal to the first direction.

13. The liquid discharging head according to claim 12, wherein the first pressure chambers are arranged at the same pitch in the second direction;

the second pressure chambers are arranged at the same pitch in the second direction;

the third pressure chambers are arranged at the same pitch in the second direction; and one of the first pressure chambers, one of the second pressure chambers and one of the third pressure chambers are arranged in this order at the same pitch therebetween in a direction orthogonal to the first direction and crossing the second and third directions.

14. The liquid discharging head according to claim 11, further comprising a third common channel which communicates with the third individual channels;

the at least one second common channel includes:

one second common channel communicating with the first individual channels, and another second common channel which is arranged between the first common channel and the third common channel in the third direction, and which communicates with both of the second individual channels and the third individual channels; and each of the one second common channel and the another second common channel has a length in the third direction which is shorter than those of the first common channel and the third common channel.

15. The liquid discharging head according to claim 1, wherein the at least one second communicating channel has two second communicating channels.

16. The liquid discharging head according to claim 15, wherein entirety of each of the two second communicating channels overlaps with the pressure chamber in the third direction.

17. The liquid discharging head according to claim 1, wherein the pressure chamber extends in a direction which is orthogonal to the first direction and which crosses the second direction and the third direction.

18. The liquid discharging head according to claim 1, wherein the pressure chamber extends in the third direction.

* * * * *